US006234164B1

(12) United States Patent
Yasui

(10) Patent No.: US 6,234,164 B1
(45) Date of Patent: May 22, 2001

(54) INTAKE AND DISCHARGE TUBE CLOSURE DETECTOR FOR COMBUSTION DEVICE OF FORCED INTAKE AND DISCHARGE TYPE

(75) Inventor: Shigeaki Yasui, Nagoya (JP)

(73) Assignee: Rinnai Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/506,590

(22) Filed: Feb. 18, 2000

(30) Foreign Application Priority Data

Feb. 19, 1999 (JP) ..... 11-040814
Jan. 21, 2000 (JP) ..... 12-013484

(51) Int. Cl.[7] ..... F23N 5/24

(52) U.S. Cl. ..... 126/110 R; 126/116 A; 431/20

(58) Field of Search ..... 126/116 A, 91 A, 126/110 R; 431/20, 30; 73/1.26, 1.25, 1.34, 1.62

(56) References Cited

U.S. PATENT DOCUMENTS 4,419,898 * 12/1983 Zanker et al. ..... 73/1.25
4,478,077 * 10/1984 Bohrer et al. ..... 73/204.26
4,708,636 * 11/1987 Johnson ..... 431/20
4,752,210 * 6/1988 Trent ..... 126/116 A
4,842,510 * 6/1989 Grunden et al. ..... 431/20
5,542,286 * 8/1996 Wang et al. ..... 73/1.34
5,601,071 * 2/1997 Carr et al. ..... 126/116 A
6,089,221 * 7/2000 Mano et al. ..... 126/116 A

* cited by examiner

*Primary Examiner*—Sara Clarke
(74) *Attorney, Agent, or Firm*—Birch, Stewart, Kolasch & Birch, LLP

(57) ABSTRACT

An orifice is disposed in an intake tube for developing a pressure difference across the orifice, i.e., portions of the intake tube which are positioned upstream and downstream of the orifice. An upstream connection pipe and a downstream connection pipe have respective ends connected to the intake tube and opening into the intake tube respectively upstream and downstream of the orifice, and respective opposite ends connected to a pressure sensor. The pressure sensor detects the pressure difference between the pressure of combustion air in the upstream connection pipe and the pressure of combustion air in the downstream connection pipe. If a change from a pressure value prior to combustion, which is a pressure value detected by the pressure sensor when the combustion fan is stopped before a burner starts burning a fuel gas, to a pressure value in combustion, which is a pressure value detected by the pressure sensor while the fuel gas is being combusted by the burner, becomes smaller than a threshold value, then the combustion of the fuel gas by the burner is stopped.

6 Claims, 9 Drawing Sheets

INTAKE AND DISCHARGE TUBE CLOSURE DETECTOR FOR COMBUSTION DEVICE OF FORCED INTAKE AND DISCHARGE TYPE

BACKGROUND OF THE INVENTION

1. Field of the Invention

The present invention relates to a combustion device of the forced intake and discharge type for introducing combustion air into a burner and discharging combustion gases from the burner with a fan, and more particularly to a closure detector for detecting an unwanted closure of an intake or discharge tube of the combustion device prior to abnormal combustion.

2. Description of the Related Art

Combustion devices of the forced intake and discharge type, which are widely used as FF (forced flue)-type air heaters, for example, introduce combustion air from the outdoors and discharge combustion gases with a fan (combustion fan). Therefore, these combustion devices are capable of burning a fuel to heat rooms without contaminating the indoor air.

In order to detect an unexpected closure such as a clogging of the intake or discharge tube of a combustion device, the combustion device may have a closure detector which comprises, for example, an orifice disposed in the intake tube and a pressure sensor for detecting the value of a pressure difference between the air pressure upstream of the orifice and the air pressure downstream of the orifice.

When an unwanted closure of the intake tube occurs, the intensity of an air flow passing through the orifice while the fan is in operation is reduced, resulting in a reduction in the pressure difference between the air pressure upstream of the orifice and the air pressure down-stream of the orifice. Therefore, while the fan is in operation, the value of the pressure difference detected by the pressure sensor is monitored, and when the detected pressure value becomes smaller than a predetermined threshold value, it is judged that the intake tube is undesirably closed, and the burner can be turned off.

However, the value of the pressure difference detected by the pressure sensor may suffer an error because of an individual characteristic difference or aging of a pressure detecting element, such as a thin-film semiconductor device, of the pressure sensor. If the detected value suffers such an error, then an unwanted closure of the intake tube cannot accurately be detected by comparison between the value of the pressure difference detected by the pressure sensor and the predetermined threshold value.

SUMMARY OF THE INVENTION

According to the present invention, there is provided a closure detector for detecting an unwanted closure of an intake or discharge tube of a combustion device of the forced intake and discharge type for introducing combustion air into a burner through the intake tube discharging combustion gases from the burner through the discharge tube with a fan, comprising an orifice disposed in the intake or discharge tube, a pressure detector for detecting the value of a pressure difference between a pressure upstream of the orifice and a pressure downstream of the orifice, memory means for storing a pressure value detected by the pressure detector before the fan operates, as a pressure value prior to operation, change detecting means for comparing a pressure value in operation, detected by the pressure detector while the fan is in operation, with the pressure value prior to operation stored by the memory means, for thereby detecting a change between the pressure value prior to operation and the pressure value in operation, and combustion stopping means for initiating the suspension of at least combustion by the burner if the absolute value of the change detected by the change detecting means is smaller than a predetermined threshold value.

The combustion stopping means stops combustion by the burner if the change, detected by the change detecting means, from the pressure value prior to operation from the pressure value in operation becomes smaller than the threshold value. Even if the pressure value detected by the pressure detector varies or suffers an error due to an individual characteristic difference or aging of the pressure detector, the variation or error is canceled out when the change detecting means detects the change from the pressure value prior to operation from the pressure value in operation. Therefore, the combustion stopping means is capable of accurately detecting an unwanted closure of the intake or discharge tube without being affected by an individual characteristic difference or aging of the pressure detector, and of stopping combustion by the burner.

The combustion stopping means may comprise means for setting the threshold value to a greater value as the rotational speed of the fan is higher.

With the above arrangement, even when the rotational speed of the fan changes, resulting in a change in the intensity of an air flow in the intake and discharge tubes, an unwanted closure of the intake or discharge tube can be determined accurately in change from the pressure values prior to operation to the pressure values during operation, depending on variations in the intensity of the air flow. Consequently, the combustion by the burner can reliably be stopped before it suffers abnormal combustion, and the burner is prevented from stopping combustion due to an erroneous detection of an unwanted closure of the intake or discharge tube.

The combustion device of the forced intake and discharge type may have room temperature detecting means for detecting the temperature of a room in which the combustion device is installed, and temperature-dependent operation control means for stopping and resuming combustion by the burner and operation of the fan based on the temperature detected by the room temperature detecting means. The memory means may comprise means for storing again the pressure value detected by the pressure detector immediately before the fan resumes its operation thereby to update the stored pressure value prior to operation, when combustion by the burner and operation of the fan are resumed by the temperature-dependent operation control means.

With the above arrangement, after the combustion by the burner and the operation of the fan are stopped, the pressure value prior to operation is updated each time the burner resumes the combustion and the fan resumes its operation. After the burner resumes the combustion and the fan resumes its operation, the change detecting means compares the pressure value in operation with the pressure value prior to operation immediately before the fan operates, for thereby detecting the change from the pressure value prior to operation to the pressure value in operation. Therefore, the change detecting means can accurately detect the change without being essentially affected by an error due to aging, etc. of the pressure detector.

The closure detector may further comprise a bypass pipe extending between portions of the intake or discharge tube which are positioned upstream and downstream of the orifice, and the pressure detector may comprise a heating resistance element having a resistance variable depending on the intensity of an air flow passing through the bypass pipe, for detecting the value of the pressure difference from the resistance of the heating resistance element.

The heating resistance element, which is relatively inexpensive, may be used as the pressure detector for detecting the pressure difference.

The closure detector may further comprise a temperature sensor for detecting the temperature in the bypass pipe, and means for correcting the value of the pressure difference detected from the resistance of the heating resistance element, based on the temperature detected by the temperature sensor.

The temperature sensor allows the pressure difference to be detected accurately without being affected by the temperature of an air flow passing through the bypass pipe.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
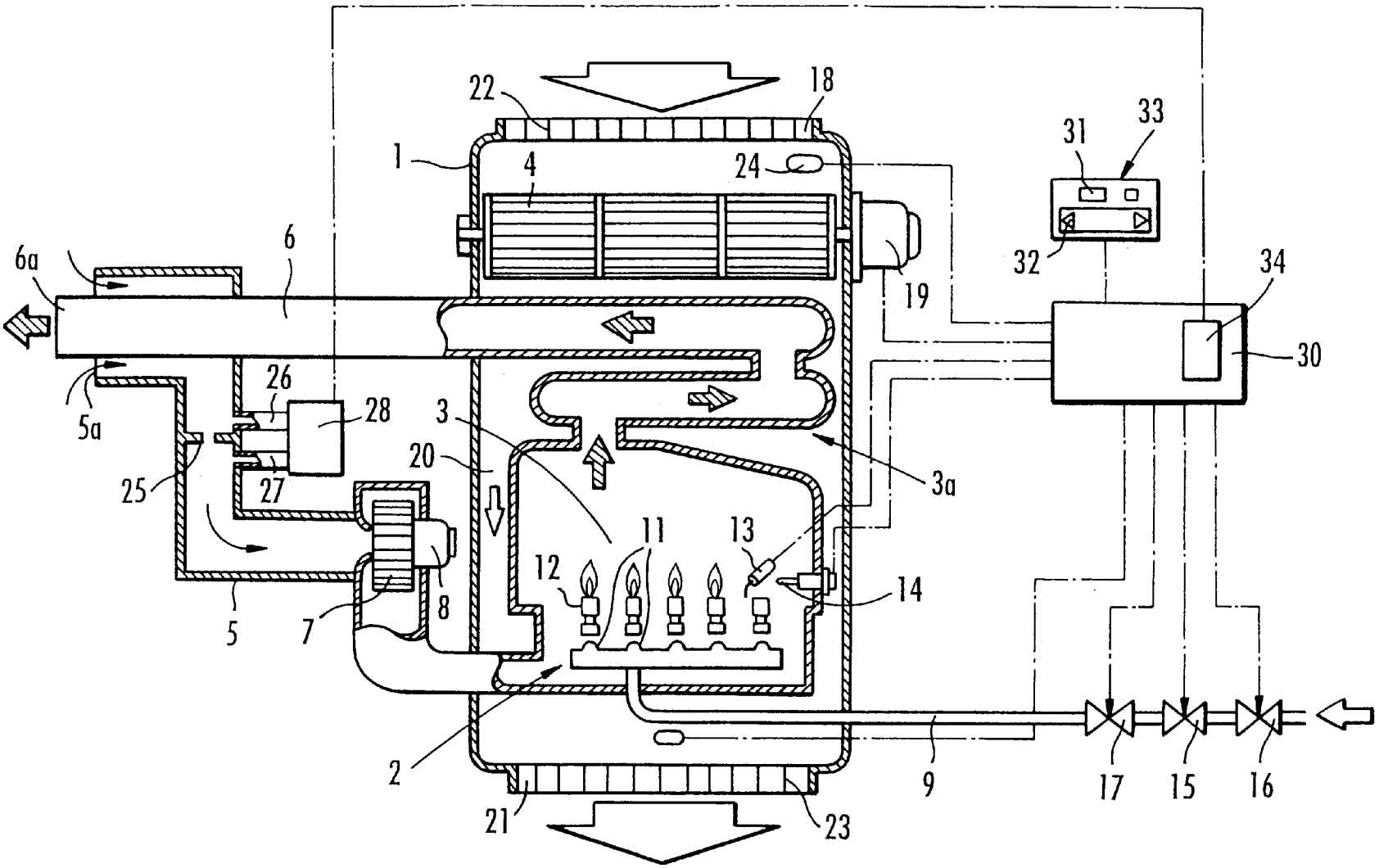
FIG. 1 is a schematic cross-sectional view of an FF-type gas heater as a combustion device of the forced intake and discharge type according to a first embodiment of the present invention.

As shown in FIG. 1, an FF-type gas heater according to a first embodiment of the present invention has a combustion chamber 3 housing a burner 2 herein, a heat exchanger 3*a* connected to the combustion chamber 3, and a convection fan 4 for introducing indoor air and discharging heated air. The combustion chamber 3, the heat exchanger 3*a*, and the convention fan 4 are accommodated in a housing 1 that is placed in a room.

To the combustion chamber 3, there are connected an intake tube 5 extending out of the housing 1 and a discharge tube 6 extending out of the housing 1 via the heat exchanger 3*a*. A combustion fan 7 for supplying combustion air to the burner 2 in the combustion chamber 3 is disposed in the intake tube 5. The combustion fan 7 can be rotated by a combustion fan motor 8 which is connected to the combustion fan 7.

Figure 2:
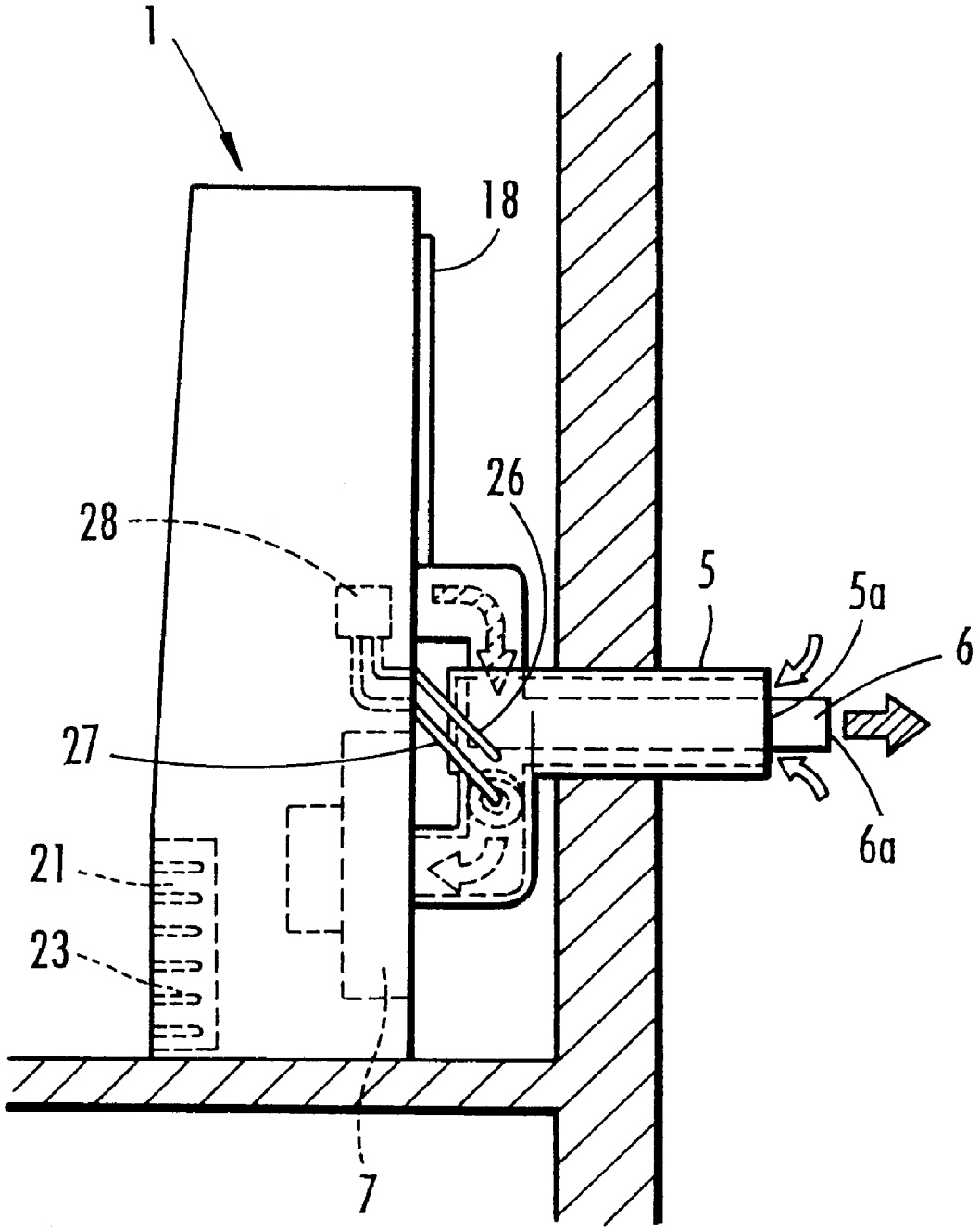
FIG. 2 is a side elevational view of the FF-type gas heater shown in FIG. 1 which is installed in position.
Figure 3:
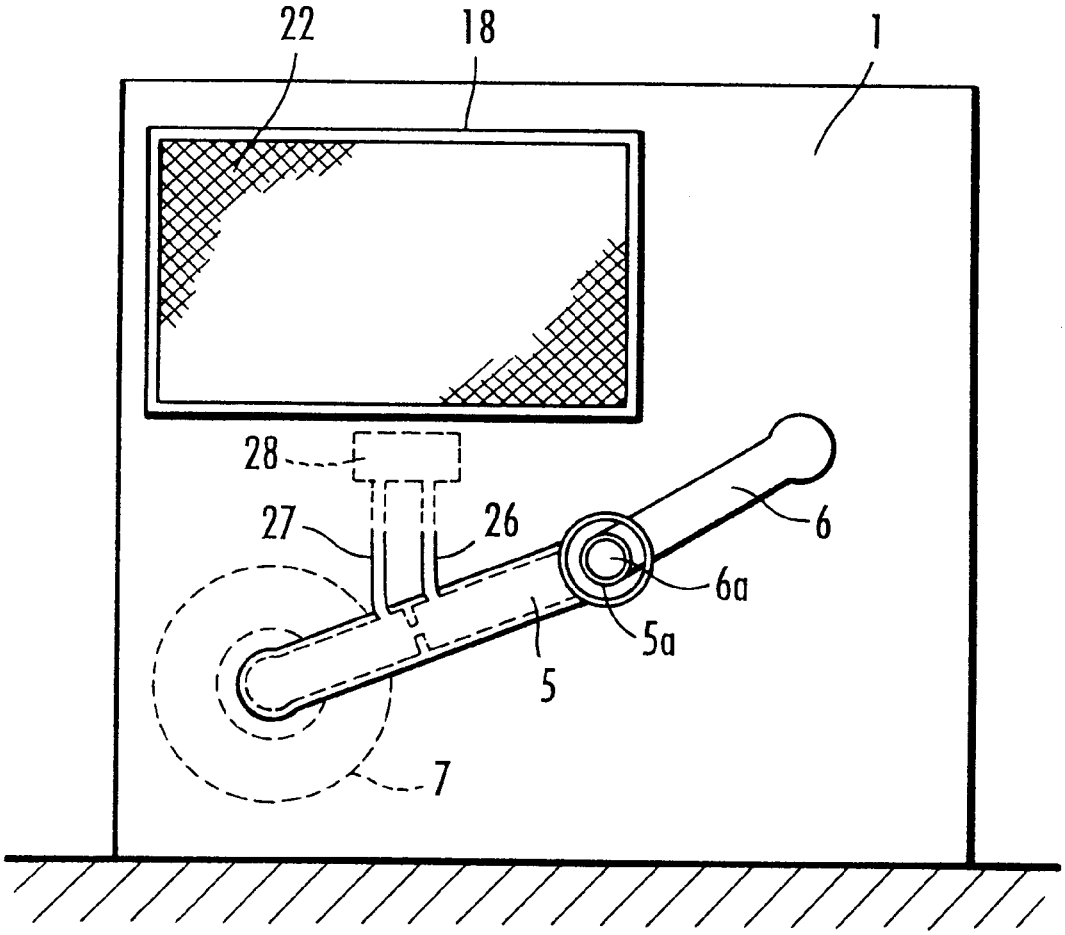
FIG. 3 is a rear elevational view of the FF-type gas heater shown in FIG. 1.

As shown in FIGS. 2 and 3, the intake tube 5 and the discharge tube 6 have respective concentric portions where the discharge tube 6 is housed in the intake tube 5. The concentric portions have open ends positioned outside of the room and serving as an intake port 5*a* and a discharge port 6*a*, respectively, of the combustion chamber 3.

As shown in FIG. 1, the burner 2 comprises a plurality of burner units 12 for drawing and mixing a combustion gas ejected from a plurality of nozzles 11 on a gas supply pipe 9 (fuel supply passage) extending into the housing 1 and combustion air introduced from the intake tube 5 into the combustion chamber 3, and ejecting a gas-air mixture into the combustion chamber 3. The gas-air mixture ejected from the burner units 12 is combusted in the combustion chamber 3. An ignition plug 13 for igniting the gas-air mixture ejected from the burner units 12 is disposed in the combustion chamber 3 near the tip ends of the burner units 12. A flame rod 14 for detecting when the ignition plug 13 fails to ignite the gas-air mixture or the burner 2 interrupts the flame is also disposed in the combustion chamber 3 near the tip ends of the burner units 12, i.e., near the ignition plug 13.

The gas supply pipe 9 has two solenoid-operated shut-off valves 15, 16 and a gas proportional valve 17.

The convection fan 4 is disposed in the housing 1 near an inlet port 18 which is defined in a rear wall of the housing 1. The convection fan 4 is connected at an end thereof to a convection fan motor 19 which rotates the convection fan 4. When the convection fan 4 is rotated by the convection fan motor 19, it draws air from the room through the inlet port 18 into the housing 1, and delivers the drawn air into an air passage 20 in which the heat exchanger 3*a* is positioned. The air that is heated by the heat exchanger 3*a* while flowing through the air passage 20 is then delivered into the room through an outlet port 21 which is defined in a front wall of the housing 1.

A filter 22 is mounted in the inlet port 18 for removing dust from the air as it flows through the inlet port 18 into the housing 1. A louver 23 is mounted in the outlet port 21 for adjusting the direction in which the heated air is delivered into the room through the outlet port 21.

A room temperature sensor 24 for detecting the temperature in the room is disposed in the housing 1 near the inlet port 18.

The intake tube 5 has an orifice 25 defined therein upstream of the combustion fan 7 which supplies combustion air to the combustion chamber 3. The orifice 25 serves to develop a pressure difference between the pressure of the combustion air upstream of the orifice 25 and the pressure of the combustion air downstream of the orifice 25 when a normal air flow is produced by the combustion fan 7 in an intake-discharge system that ranges from the intake tube 5 through the combustion chamber 3 to the discharge tube 6.

An upstream connection pipe 26 and a downstream connection pipe 27 have respective ends connected to the intake tube 5 and opening into the intake tube 5 respectively upstream and downstream of the orifice 25. The up-stream connection pipe 26 and the downstream connection pipe 27 have respective opposite ends connected to a pressure sensor 28 (pressure detecting element) which detects the pressure difference between the pressure of combustion air in the upstream connection pipe 26 and the pressure of combustion air in the downstream connection pipe 27.

The pressure sensor 28 detects the pressure difference between the pressure of combustion air upstream of the orifice 25 and the pressure of combustion air downstream of the orifice 25 through the upstream connection pipe 26 and the downstream connection pipe 27. For example, the pressure sensor 28 comprises a thin-film semiconductor device having a thin film whose electrostatic capacitance varies depending on the difference between pressures applied to respective opposite surfaces thereof.

The pressure sensor 28 includes a casing having a partition or separator disposed therein, with the thin-film semiconductor device being mounted on the partition or separator such that the opposite surfaces of the thin-film semiconductor device faces different compartments, respectively, defined in the casing. The ends of the upstream connection pipe 26 and the downstream connection pipe 27 are open in the respective compartments in the casing.

The FF-type gas heater also has a controller 30 for controlling operation thereof and a control console 33 having an operation switch 31 and a room temperature setting switch 32, etc.

The controller 30 comprises an electronic circuit including a microcomputer, etc., and performs the functions of a memory means for storing a pressure value prior to operation, a change detecting means, and a combustion stopping means. The controller 30 actuates and controls the ignition plug 13, the solenoid-operated shut-off valves 15, 16, the gas proportional valve 17, the combustion fan motor 8, and the convection fan motor 19 for carrying out ignition control, combustion control, and heating capability control.

The controller 30 also carries out safety control for preventing the burner 2 from causing abnormal combustion. For such safety control, the controller 30 has a pressure detector 34 in association with the pressure sensor 28.

The pressure detector 34 and the controller 30 performs a control process for detecting an unwanted closure of the intake tube 5 and the discharge tube 6 as follows:

As described above, the ends of the upstream connection pipe 26 and the downstream connection pipe 27 are open in the respective compartments in the casing of the pressure sensor 28 which are faced by the respective opposite surfaces of the thin-film semiconductor device. The electrostatic capacitance of the thin-film semiconductor device varies depending on the difference between the air pressure in the upstream connection pipe 26 and the air pressure in the downstream connection pipe 27.

Figure 4:
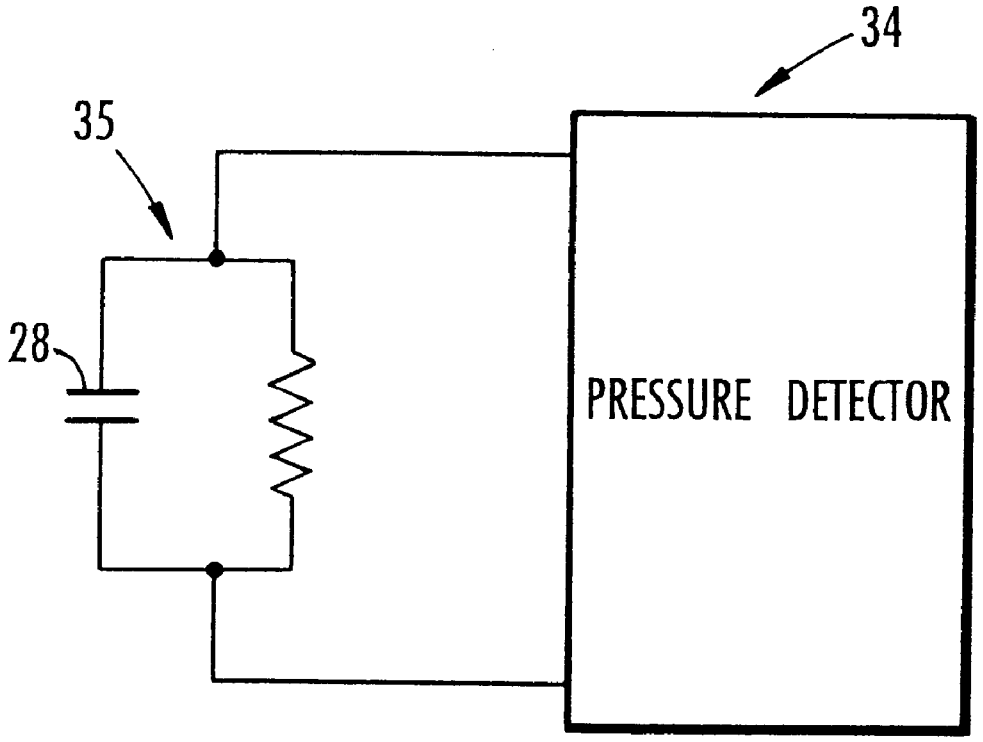
FIG. 4 is a circuit diagram of an oscillating circuit for a pressure sensor according to the first embodiment.

As shown in FIG. 4, the pressure detector 34 detects the oscillation frequency of an oscillating circuit 35 which comprises a resistor and a capacitor as the thin-film semiconductor device. Since the oscillation frequency of the oscillating circuit 35 is determined depending on the electrostatic capacitance of the pressure sensor 28, the oscillation frequency of the oscillating circuit 35 varies depending on the difference between the air pressure in the upstream connection pipe 26 and the air pressure in the downstream connection pipe 27.

The electrostatic capacitance of the thin-film semiconductor device of the pressure sensor 28 varies due to an individual characteristic difference or aging thereof. If the value of the pressure difference between the upstream connection pipe 26 and the downstream connection pipe 27 as detected from the oscillation frequency of the oscillating circuit 35 varies due to an individual characteristic difference or aging of the thin-film semiconductor device, then the controller 30 cannot accurately determine an unwanted closure of the intake tube 5 or the discharge tube 6 based on comparison between the detected pressure value and a predetermined threshold value.

According to the present invention, before an air stream is generated by the combustion fan 7 in the intake-discharge system, i.e., when no pressure difference is developed across the orifice 25, the controller 30 detects the oscillation frequency of the oscillating circuit 35 and stores the detected oscillation frequency as a pressure value prior to operation, which is a pressure value in pressure equilibrium. Thereafter, when the combustion fan 7 is operated and an air stream is generated in the intake-discharge system including the combustion chamber 3, the controller 30 detects the oscillation frequency of the oscillating circuit 35 as a pressure value in operation, and compares the pressure value in operation with the pressure value prior to operation for thereby detecting an unwanted closure of the intake tube 5 or the discharge tube 6 depending on whether a normal pressure difference is developed across the orifice 25 or not.

In order to determine whether an unwanted closure of the intake tube 5 or the discharge tube 6 has occurred or not, the controller 30 detects a change from the pressure value prior to operation (the oscillation frequency of the oscillating circuit 35 which is detected while the combustion fan 7 is at rest) to the pressure value in operation (the oscillation frequency of the oscillating circuit 35 which is detected while the combustion fan 7 is in operation). If the detected change is equal to or greater than, i.e. 8 kHz the threshold value, then the controller 30 determines that there is a pressure difference, i.e. 5 $mmH_2O$ or more, developed across the orifice 25, and a normal air flow is present in the intake tube 5. Conversely, if the detected change is smaller than as the threshold value, then the controller 30 determines that no normal air flow is present in the intake tube 5 and an unwanted closure is occurring in the intake tube 5 or the discharge tube 6.

Figure 6:
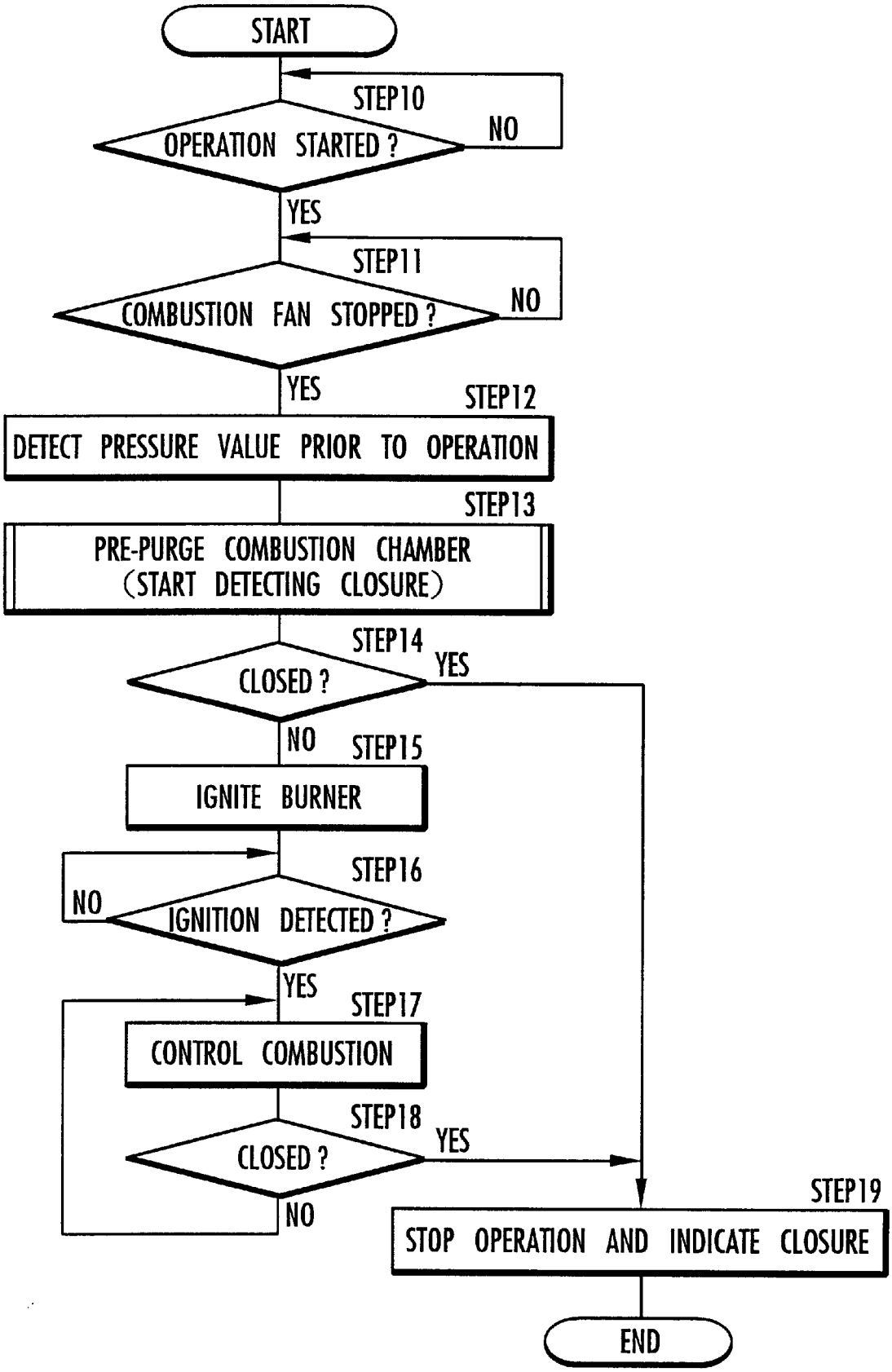
FIG. 6 is a flowchart of an operation sequence of the FF-type gas heater according to the first embodiment.

A safety control process carried out by the pressure detector 34 and the controller 30 based on the detection of the value of the pressure difference across the orifice 25, as well as operation of the FF-type gas heater, will be described below with reference to FIG. 6.

Figure 5:
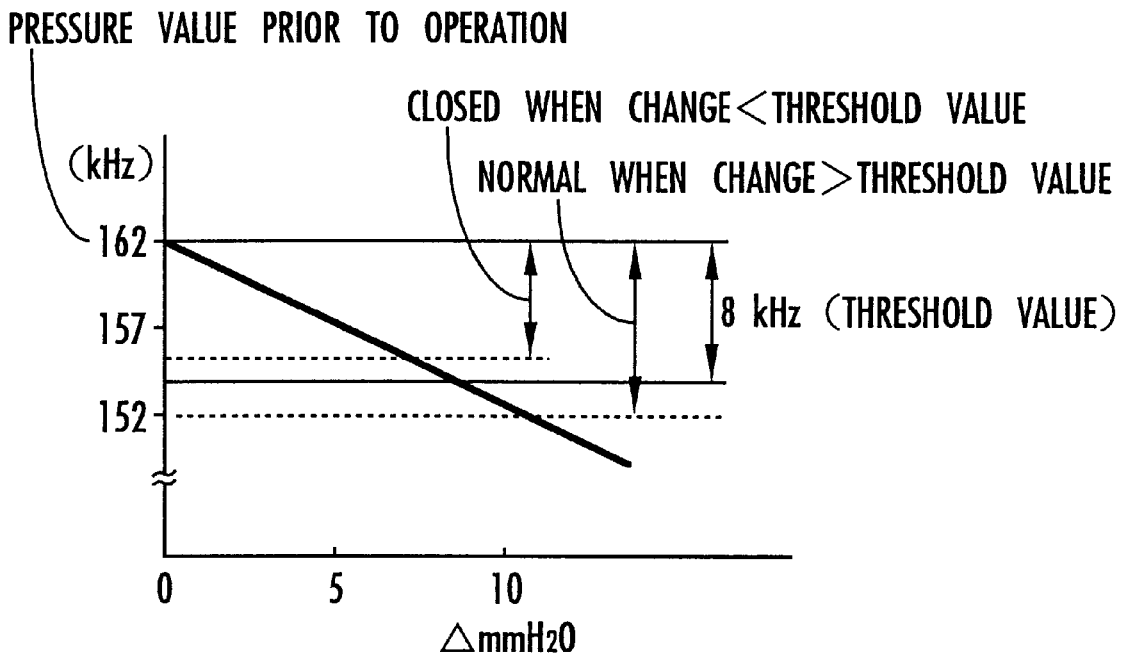
FIG. 5 is a diagram showing the relationship between the oscillation frequency of the oscillating circuit and a pressure difference developed by an orifice according to the first embodiment.

When the user of the FF-type gas heater operates the operation switch 31 to start operating the FF-type gas heater in STEP10 (YES), the controller 30 confirms the stopping of the combustion fan 7 (the rotational speed=0 rpm) in STEP11 (YES), and detects the oscillation frequency of the oscillating circuit 35 and stores the detected oscillation frequency as a pressure value prior to operation (e.g., 162 kHz in FIG. 5) in STEP12. In the first embodiment, the threshold value is a constant value of 8 kHz.

Then, the controller 30 controls the combustion fan motor 8 to rotate the combustion fan 7 at a predetermined speed of 3000 rpm, for example, to pre-purge the combustion chamber 3 with air supplied from the intake tube 5 in STEP13. After having started to pre-purge the combustion chamber 3, the controller 30 starts to detect an unwanted closure of the intake tube 5 and the discharge tube 6 by comparing the oscillation frequency of the oscillating circuit 35 (the pressure value in operation) with the stored pressure value prior to operation to detect a change from the pressure value prior to operation to the pressure value in operation.

While the combustion fan 7 is in operation, the controller 30 calculates a change from the pressure value prior to operation to the pressure value in operation at all times. If the change is smaller than the threshold value of 8 kHz in STEP14 (YES), then the controller 30 determines that an unwanted closure of the intake tube 5 or the discharge tube 6 has occurred, and stops pre-purging the combustion chamber 3. The controller 30 does not ignite the burner 2, but indicates the tube closure with a sound generator (not shown) on the control console 33 and with a visual indicator (not shown) on the control console 33, and stops operating the FF-type gas heater in STEP19.

If no unwanted closure is detected while the combustion chamber 3 is being pre-purged in STEP14, then the controller 30 pre-purges the combustion chamber 3 for a predetermined period of time, and thereafter controls the combustion fan motor 8 to rotate the combustion fan 7 at 1300 rpm, for example. The controller 30 then energizes the ignition plug 13, opens the solenoid-operated shut-off valves 15, 16, and actuates the gas proportional valve 17 to supply a predetermined amount of fuel gas to the burner 2 to ignite the burner 2 in STEP15.

The controller 30 detects whether the burner 2 is ignited based on a detected combustion signal from the flame rod 14 in STEP16. If the controller 30 detects an ignition of the burner 2 in STEP16 (YES), then the controller 30 controls the convection fan motor 19 to rotate the convection fan 4 to start sending heated air into the room. If the controller 30 confirms continued combustion of the fuel gas by the burner 2, then the controller 30 controls the combustion by the burner 2 dependent on the temperature setting of the room temperature setting switch 32 and the room temperature detected by the room temperature sensor 24 in STEP17.

While the fuel gas is continuously being burned by the burner 2, the controller 30 always compares a change from the pressure value prior to operation to the pressure value in operation which is detected by the pressure sensor 28, with the threshold value. If the detected change drops below the threshold value in STEP18 (YES), then the controller 30 determines that the intake tube 5 or the discharge tube 6 suffers an unwanted closure, and closes the solenoid-operated shut-off valves 15, 16 to stop burning the fuel gas with the burner 2 and indicates the tube closure in STEP19.

According to the first embodiment, as described above, the controller 30 stores the value detected by the pressure sensor 28 which detects the pressure difference across the orifice 25 in the intake tube 5, as a pressure value prior to operation, i.e., before the combustion fan 7 operates. While the combustion fan 7 is operating, the controller 30 compares a change from the pressure value prior to operation to a pressure value in operation which is detected by the pressure sensor 28, with the threshold value for thereby determining whether the intake tube 5 or the discharge tube 6 suffers an unwanted closure or not. Consequently, the controller 30 is capable of accurately detecting an unwanted closure of the intake tube 5 or the discharge tube 6 without being affected by an individual characteristic difference of the pressure sensor 28.

Even when the pressure sensor 28 and the oscillating circuit 35 is subjected to aging, the controller 30 is capable of accurately detecting an unwanted closure of the intake tube 5 or the discharge tube 6 without being affected by such aging because the controller 30 detects such an unwanted closure based on a change from the pressure value detected by the pressure sensor 28 before FF-type gas heater operates.

Therefore, the controller 30 can reliably stop combustion of the fuel gas by the burner 2 before the burner 2 suffers abnormal combustion.

An FF-type gas heater according to a second embodiment of the present invention will be described below with reference to FIG. 7. The FF-type gas heater according to the second embodiment is basically the same as the FF-type gas heater according to the first embodiment except for the pressure sensor 28.

Figure 7:
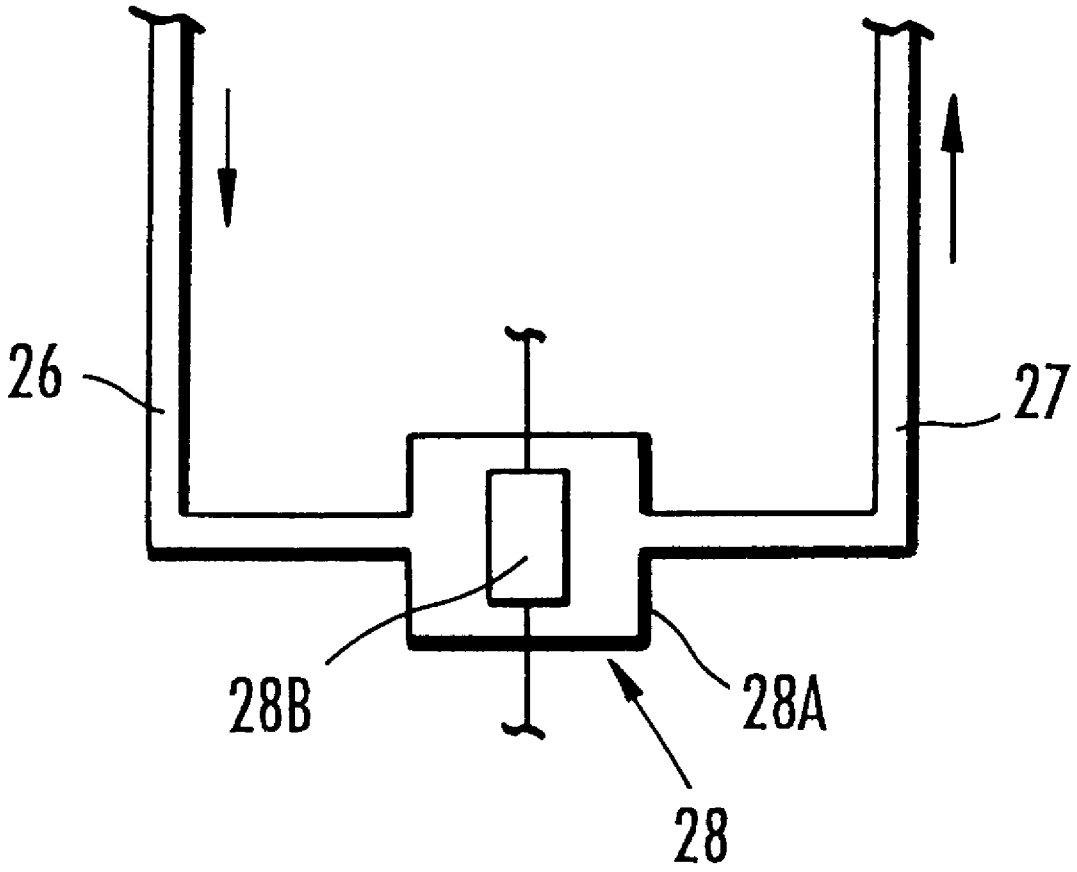
FIG. 7 is a schematic view of a pressure sensor of an FF-type gas heater according to a second embodiment of the present invention.

According to the second embodiment, as shown in FIG. 7, the upstream connection pipe 26 and the downstream connection pipe 27 are connected directly to each other, forming a bypass pipe which provides fluid communication across the orifice 25, i.e., between portions of the intake tube 5 which are positioned upstream and downstream of the orifice 25. The junction between the upstream connection pipe 26 and the downstream connection pipe 27 has a pressure detection chamber 28A in which there passes an air flow from the upstream connection pipe 26 to the downstream connection pipe 27, the air flow having an intensity that varies depending on the pressure difference across the orifice 25. The pressure detection chamber 28A houses therein a heating resistance element 28B such as a resistor whose temperature changes depending on the intensity of the air flow that passes across the heating resistance element 28B in the pressure detection chamber 28A.

A voltage (DC voltage) is applied to the heating resistance element 28B at all times. The voltage across the heating resistance element 28B changes depending on the resistance thereof which changes depending on its temperature. Therefore, when the voltage across the heating resistance element 28B is detected to detect the resistance of the heating resistance element 28B, the value of the pressure difference across the orifice 25 can be detected. The voltage across the heating resistance element 28B can easily be detected by a known technique, e.g., by connecting another resistor in series to the heating resistance element 28B.

Figure 8:
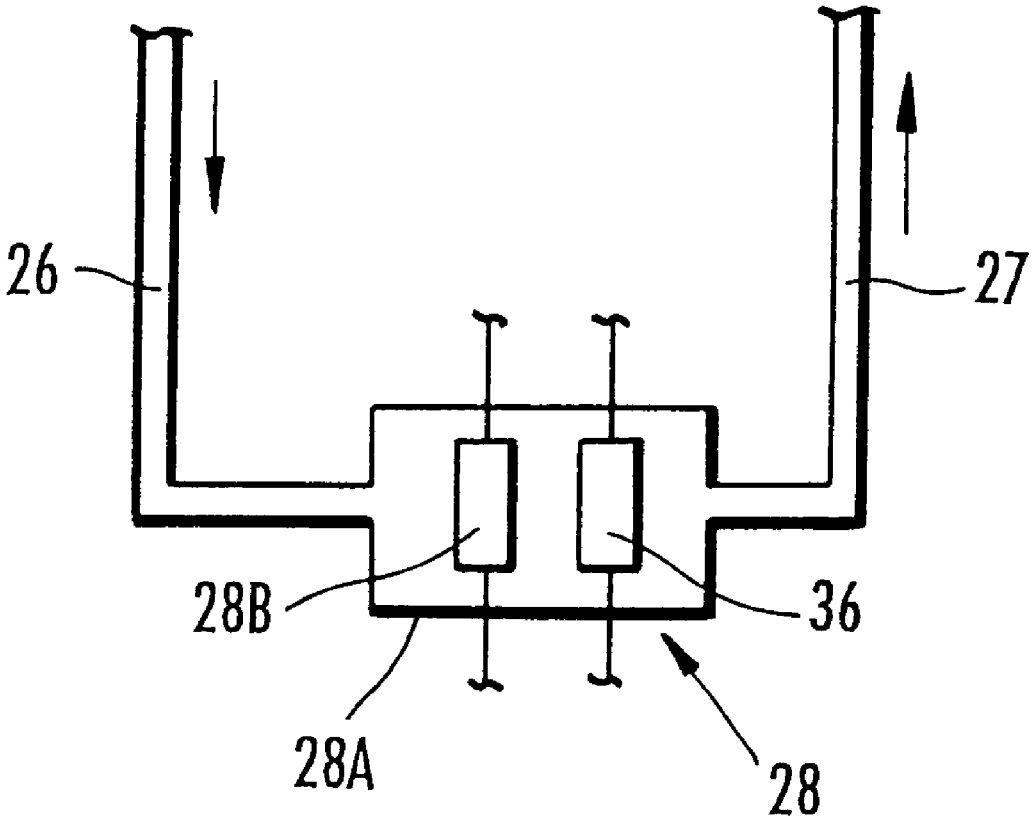
FIG. 8 is a schematic view of a pressure sensor of an FF-type gas heater according to a third embodiment of the present invention.

An FF-type gas heater according to a third embodiment of the present invention will be described below with reference to FIG. 8.

According to the third embodiment, a thermistor 36 (temperature sensor) for detecting a temperature is disposed in the pressure detection chamber 28A parallel to and near the pressure sensor 28 according to the second embodiment. The output value from the pressure sensor 28 which comprises the heating resistance element 28B is corrected based on the temperature detected by the thermistor 36, so that an unwanted closure of the intake tube 5 and the discharge tube 6 can be detected more accurately without being affected by the temperature of the air flow that passes through the intake tube 5.

An FF-type gas heater according to a fourth embodiment of the present invention will be described below.

The intensity of an air flow that is produced in the intake tube 5 by the combustion fan 7 varies depending on the rotational speed of the combustion fan 7, and the pressure difference developed across the orifice 25 also varies depending on the rotational speed of the combustion fan 7. In the first through third embodiments, the threshold value is constant irrespective of those changes in the intensity of the air flow and the pressure difference across the orifice 25. For more accurately detecting an unwanted closure of the intake tube 5 and the discharge tube 6, it is effective to establish a threshold value that depends on the rotational speed of the combustion fan 7.

Specifically, the rotational speed of the combustion fan motor 8 for rotating the combustion fan 7 is detected, and the threshold value is set up such that the threshold value is greater as the detected rotational speed of the combustion fan motor 8 is higher. Alternatively, since the rotational speed of the combustion fan 7 is determined depending on the amount of combustion, the threshold value may be made greater as data indicative of the amount of combustion or control data for the gas proportional valve 17 is greater.

Figure 9:
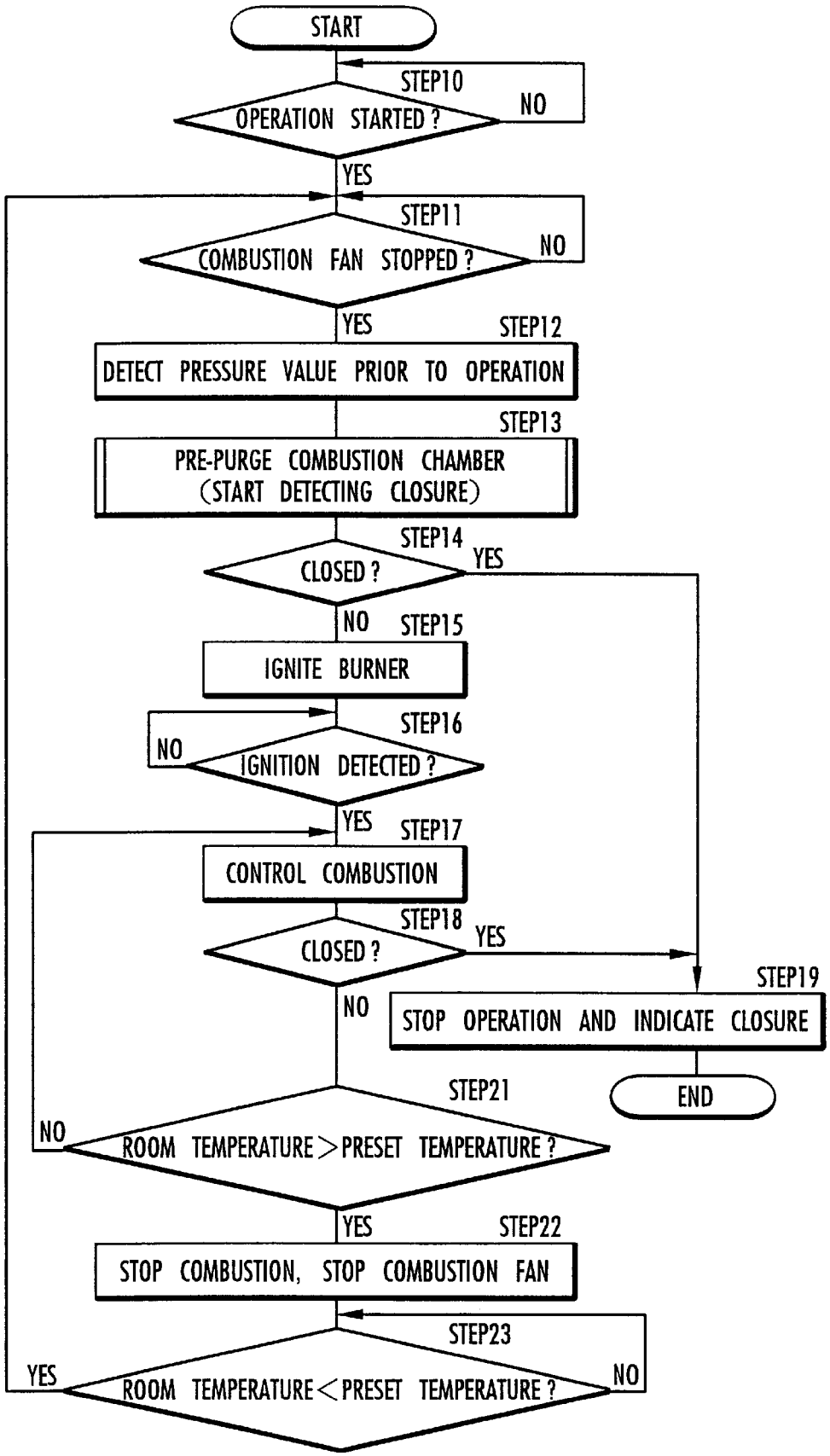
FIG. 9 is a flowchart of an operation sequence of an FF-type gas heater according to a fifth embodiment of the present invention.

An FF-type gas heater according to a fifth embodiment of the present invention will be described below with reference to FIG. 9.

In the first through fourth embodiments, the state prior to operation of the combustion fan 7 is the same as the state prior to operation of the FF-type gas heater, and the pressure value prior to operation is constant while the FF-type gas heater is in operation. According to the fifth embodiment, if the temperature detected by the room temperature sensor 24 has reached a room temperature set by the room temperature setting switch 32 while the FF-type gas heater is in operation in STEP21 (YES), the controller 30 stops burning the fuel gas and stop operating the combustion fan 7 (thermostat-controlled turn-off) in STEP22. Thereafter, if the room temperature drops below the room temperature setting in STEP23 (YES), then the controller 30 resumes combustion of the fuel gas and operation of the combustion fan 7 (thermostat-controlled turn-on). In this manner, if the room temperature is to be kept at the room temperature setting, then the pressure difference across the orifice 25 when the combustion of the fuel gas is stopped, i.e., when the combustion fan 7 is stopped, in STEP22, may be read again and updated.

After the FF-type gas burner resumes its operation, the pressure value in operation is compared with the pressure value prior to operation when the combustion fan 7 is stopped immediately before the FF-type gas burner resumes its operation. Therefore, a change from the pressure value prior to operation to the pressure value in operation can be detected without being affected by a elapse of any significant period of time, so that an unwanted closure of the intake tube 5 and the discharge tube 6 can be detected much more accurately.

Although certain preferred embodiments of the present invention have been shown and described in detail, it should be understood that various changes and modifications may be made therein without departing from the scope of the appended claims.

What is claimed is:

1. A forced intake and discharge combustion device, comprising:

an intake tube;

a discharge tube;

a burner;

a fan for introducing combustion air into the burner through the intake tube and for discharging combustion gases from the burner through the discharge tube;

a closure detector for detecting an undesirable closure of the intake tube or the discharge tube; and combustion stopping means for at least initiating a suspension of combustion by said burner if the closure detector detects the undesirable closure;

said closure detector comprises:

an orifice plate in the intake tube or the discharge tube;

a pressure detector for detecting pressure difference values between a pressure upstream of said orifice plate and a pressure downstream of said orifice plate;

memory means for storing a first pressure difference value in a condition prior to operation of said fan;

change detecting means for comparing a second pressure difference value detected by said pressure detector in a condition while said fan is in operation with said first pressure difference value, in order to detect a pressure variation between said first pressure difference value and said second pressure difference value; and determining means for detecting said undesirable closure if the absolute value of said pressure variation detected by said change detecting means is smaller than a predetermined threshold value.

2. A forced intake and discharge combustion device according to claim 1, wherein said combustion stopping means comprises means for setting said predetermined threshold value to a greater value as the fan's rotational speed increases.

3. A forced intake and discharge combustion device according to claim 2, further comprising:

room temperature detecting means for detecting the temperature of a room in which the combustion device is installed; and temperature-dependent operation control means for stopping and resuming combustion by said burner and operation of said fan based on the temperature detected by the room temperature detecting means;

wherein said memory means comprises means for storing the pressure value detected by said pressure detector immediately before the fan resumes its operation to thereby update the stored pressure value prior to operation, when combustion by the burner and operation of said fan are resumed by said temperature-dependent operation control means.

4. A forced intake and discharge combustion device according to claim 1, further comprising:

room temperature detecting means for detecting the temperature of a room in which the combustion device is installed; and temperature-dependent operation control means for stopping and resuming combustion by said burner and operation of said fan based on the temperature detected by the room temperature detecting means;

wherein said memory means comprises means for storing the pressure value detected by said pressure detector immediately before the fan resumes its operation to thereby update the stored pressure value prior to operation, when combustion by the burner and operation of said fan are resumed by said temperature-dependent operation control means.

5. A forced intake and discharge combustion device according to claim 1, wherein said closure detector comprises a bypass pipe extending between portions of the intake or discharge tube which are positioned upstream and downstream of said orifice plate, and said pressure detector comprises a heating resistance element having a resistance variable depending on either a pressure or a velocity of an air flow passing through said bypass pipe in order to detect said pressure difference values from the resistance of said heating resistance element.

6. A forced intake and discharge combustion device according to claim 5, wherein said closure detector comprises a temperature sensor for detecting a temperature in said bypass pipe, and means for correcting the value of said heating resistance element, based on the temperature detected by said temperature sensor.

* * * * *